US010646908B2

(12) United States Patent
Bigoni et al.

(10) Patent No.: US 10,646,908 B2
(45) Date of Patent: May 12, 2020

(54) MACHINE FOR WINDING COILS

(71) Applicant: DANIELI & C. OFFICINE MECCANICHE S.P.A., Buttrio (IT)

(72) Inventors: Andrea Bigoni, Remanzacco (IT); Daniel Polito, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 448 days.

(21) Appl. No.: 15/516,922

(22) PCT Filed: Oct. 6, 2015

(86) PCT No.: PCT/IB2015/057639
§ 371 (c)(1),
(2) Date: Apr. 5, 2017

(87) PCT Pub. No.: WO2016/055937
PCT Pub. Date: Apr. 14, 2016

(65) Prior Publication Data
US 2017/0297071 A1 Oct. 19, 2017

(30) Foreign Application Priority Data
Oct. 6, 2014 (IT) ..... UD2014A0159

(51) Int. Cl.
*B21C 47/06* (2006.01)
*B21C 47/02* (2006.01)
*B21C 47/34* (2006.01)

(52) U.S. Cl.
CPC ..... *B21C 47/066* (2013.01); *B21C 47/02* (2013.01); *B21C 47/34* (2013.01)

(58) Field of Classification Search
CPC ..... B21C 47/003; B21C 47/02; B21C 47/066; B21C 47/08; B21C 47/10; B21C 47/14; B21C 47/326; B21C 47/34
See application file for complete search history.

(56) References Cited

U.S. PATENT DOCUMENTS 3,328,991 A * 7/1967 Petros ..... B21C 47/066 72/148
7,357,383 B2 * 4/2008 D'Alessandro ..... B21C 33/00 269/131

FOREIGN PATENT DOCUMENTS

DE 10 95 772 12/1960
DE 11 68 203 4/1964
FR 1112469 A * 3/1956 ..... B21C 47/326

OTHER PUBLICATIONS

International Search Report filed in PCT/IB2015/057639 dated Jan. 25, 2016.

* cited by examiner

*Primary Examiner* — Pradeep C Battula
(74) *Attorney, Agent, or Firm* — Rankin, Hill & Clark LLP

(57) ABSTRACT

A machine for winding coils comprising at least one support frame, a belt having a closed-ring configuration installed on the support frame so as to substantially surround it peripherally, and a platform on which the at least one support frame is positioned. The platform is provided with support elements configured to selectively support the at least one support frame in a distanced position with respect to the platform. Actuation members are associated with at least some of said support elements, and are able to be selectively activated to take at least some of said support elements to a first operating position constraining the support frame to the platform, and to a second non-operating position of non-interference with said support frame.

10 Claims, 3 Drawing Sheets

MACHINE FOR WINDING COILS

FIELD OF THE INVENTION

The present invention concerns a machine for winding coils of rolled products such as metal sheets, for example aluminum, copper, steel or their possible alloys.

In particular, the machine according to the present invention can be used in association with a winding shaft, or mandrel, and be configured to facilitate or trigger at least the first winding steps of the rolled product on the winding shaft.

BACKGROUND OF THE INVENTION

Machines for winding coils of rolled products are known, also known as belt wrappers, used for winding a rolled product on a winding shaft or mandrel and for forming a coil.

For example, a machine for winding coils is known, which comprises a support frame, selectively movable for example on sliding guides, nearer to or away from the winding shaft.

The support frame is provided with a concave portion which partly surrounds the winding shaft during use.

At least one closing arm is hinged, with one end, to the support frame, in correspondence with the concave portion, and can be selectively taken to a first position in which it at least partly closes the concave portion, thus surrounding the winding shaft during use, and a second position where the concave portion is open. In the second position, the closing arm is taken to a condition of non-interference with the winding shaft, for example during the movement of the support frame along the sliding guides.

Guide and return rolls are installed on the support frame and on the closing arm, with axes of rotation substantially parallel to those of the winding shaft.

A belt is wound on the guide and return rolls, with a closed-ring configuration that substantially surrounds the support frame on the perimeter.

In correspondence with the concave portion of the support frame and the closing arm, a segment of belt is defined which, during use, at least partly surrounds the periphery of the winding shaft.

A tensioner device is also normally associated with the support frame, suitable to regulate the tension of the belt.

When the operations to wind the rolled product on the winding shaft are started, the support frame is translated along the sliding guides to take the concave portion of the latter into proximity with the winding shaft. In this condition, the closing arm is kept in an open position so that the belt, during translation, moves to surround the winding shaft peripherally.

In this condition the support arm is taken to its closed position so that a segment of belt surrounds a substantial part, for example at least 270°, of the circumference of the winding shaft.

In this condition, the rolled product is fed toward the winding shaft and is positioned between the external surface of the winding shaft and the belt.

The belt exerts on the rolled product a pressure suitable to keep it adherent and resting completely against the external surface of the winding shaft.

The winding shaft is made to rotate to wind the rolled product on it.

Once some spirals of rolled product have been wound, generally two to four, the friction generated between them is sufficient to allow to wind the remaining rolled product onto the winding shaft and hence to form the coil.

This solution therefore provides that the closing arm is taken to its open position and the support frame is retracted along the sliding guides to move to a condition of non-interference with the coil being formed.

Merely by way of non-restrictive example of the present invention, an aluminum rolled product with a thickness comprised between 10 mm and 20 mm is generally fed to the winding shaft at a speed comprised between 0.2 and 1.8 m/s, and generally has a temperature varying between 350° C. and 500° C. These conditions are very onerous, at least for the belt which, due to the great friction generated with the rolled product, is subject to great wear and needs frequent maintenance and replacement interventions.

The operations to replace the belt require that the operators remove substantial parts of the support frame to generate the spaces needed for the passage and installation of the belt on the guide and return rolls.

In particular, for installation the belt is supplied in its open form, for example having separated the meshes of which it is made.

Once open, the belt is inserted into the machine with one end edge in a direction substantially parallel to the direction of feed of the metal product.

The replacement operations are particularly complex and time-consuming in terms of dis-assembling and re-assembling the belt and parts of the support frame. This also entails long stoppages in production.

One purpose of the present invention is to obtain a machine for winding coils of the type described above, which allows to simplify and accelerate the maintenance operations, in particular those connected to replacing the belt.

Another purpose of the present invention is to obtain a machine for winding coils which allows to automate as much as possible the maintenance operations to be carried out on it, for example to replace the belt.

Another purpose of the present invention is to obtain a machine for winding coils which allows to use belts with a directly closed-ring structure and which therefore are not obtained by connecting their end edges. This also allows to limit the generation of surface defects on the rolled product due to its contact with the joints in the belt.

Another purpose is to perfect a method for replacing a belt in a machine for winding coils that is simple and quick.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a machine for winding coils comprises at least one support frame, a belt having a closed-ring configuration installed on the support frame so as to substantially surround it peripherally, and a platform on which the at least one support frame is positioned.

According to one aspect of the present invention, the platform is provided with support elements configured to selectively support the at least one support frame in a distanced position with respect to the platform.

According to another aspect of the present invention, actuation members are associated with at least some of said support elements, and are able to be selectively activated to take at least some of the support elements to a first operating position constraining the support frame to the platform, and to a second non-operating position of non-interference with the support frame. In the second non-operating position of at least some of the support elements, an interspace is defined between the platform and the support frame suitable for the lateral insertion and installation of the belt on the support frame. The interspace that is generated between the platform and the support frame allows to dispose at least the peripheral part of the latter, on which the belt is installed, in a position free from interference of the support elements. The latter are disposed in a position of non-interference with the operations of lateral insertion or lateral removal of the belt. This allows to carry out the installation or the removal of the belt always keeping it in the closed-ring configuration and not requiring its separation. Moreover, the presence of the selectively movable support elements makes the maintenance operations much quicker, as complex and time-consuming operations to remove or install substantial parts of the machine are no longer necessary.

According to one form of embodiment of the invention, the platform is provided with first support elements configured to support the at least one support frame in correspondence with a first lateral flank thereof, and with second support elements configured to support the at least one support frame in correspondence with a second lateral flank thereof, opposite the first lateral flank. Moreover, the actuation members are associated at least with one of either the first support elements or the second support elements.

According to possible solutions, the at least one support frame comprises a support body interposed between the first lateral flank and the second lateral flank and on which the belt is installed during use.

According to other forms of embodiment, the actuation members are associated with the first support elements, and when the first support elements are in their second non-operating position, at least the second support elements support the at least one support frame in correspondence with the second flank, keeping the support body and the first lateral flank cantilevered.

Forms of embodiment of the present invention also concern a method to install or replace a belt of a machine for winding coils as described above. The method comprises at least one operation to insert or remove the belt from the support frame.

According to one aspect of the present invention, it is provided to support the support frame on a platform by means of support elements that keep the support frame distanced with respect to the platform.

According to another aspect, before said operation to insert or remove the belt, at least some of the support elements are taken from a first operating position constraining the support frame to the platform, to a second non-operating position of non-interference with the support frame to define an interspace between the platform and the support frame. The other support elements keep the support frame constrained to the platform. During said insertion or removal operation it is provided to insert or remove at least part of the belt laterally through the interspace.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
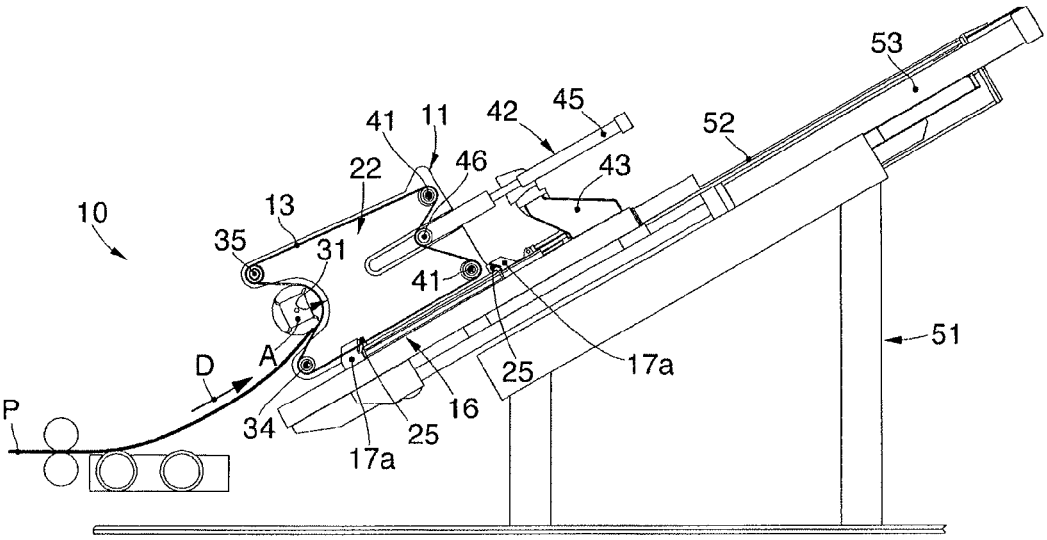
FIG. 1 is a lateral schematic view of a machine for winding coils in one operating condition.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME FORMS OF EMBODIMENT

With reference to FIG. 1, a machine for winding coils is indicated in its entirety by the reference number 10 and comprises at least a support frame 11, 12, or support body, also called cartridge, on which at least one belt 13, 14 is installed, in the manner described hereafter.

Figure 2:
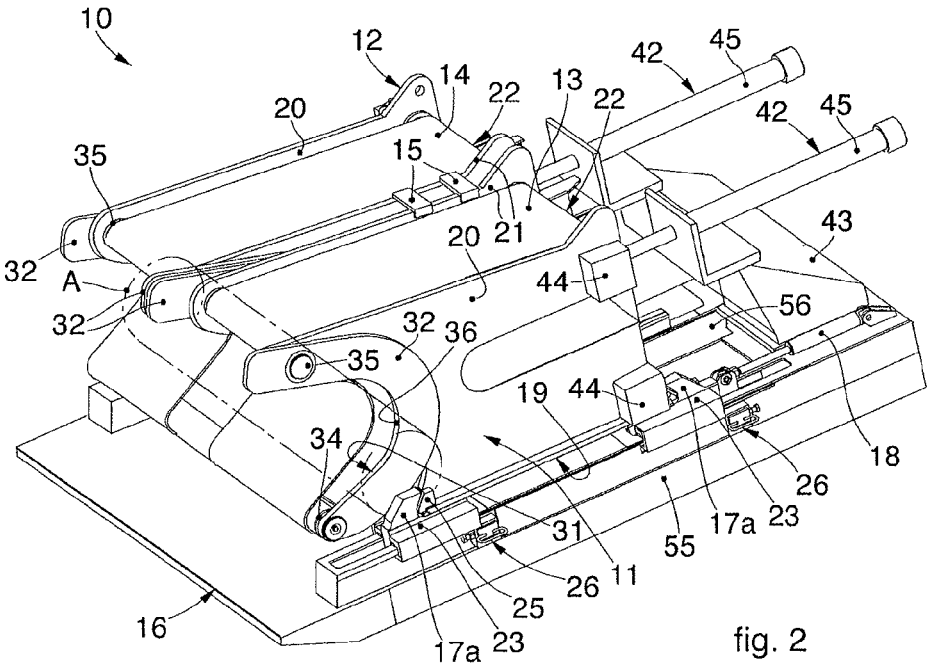
FIG. 2 is a perspective view of a machine for winding coils according to a first form of embodiment.
Figure 4:
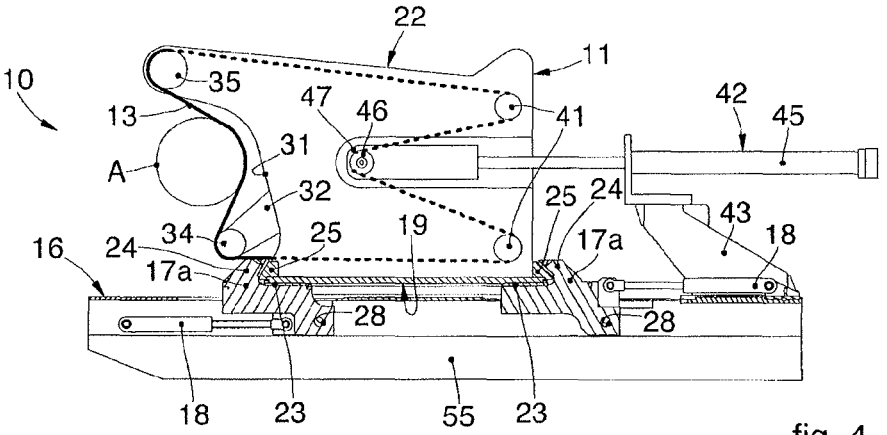
FIG. 4 is a section view along the section line of FIG. 3 of the machine in a first operating position.

According to some forms of embodiment, the machine for winding coils 10 is configured to wind, on a winding shaft A, schematically shown in FIGS. 1, 2 and 4, a rolled product P, for example a metal sheet, made of aluminum, steel, copper or possible metal alloys. The rolled product P is fed in a direction of feed D.

Figure 3:
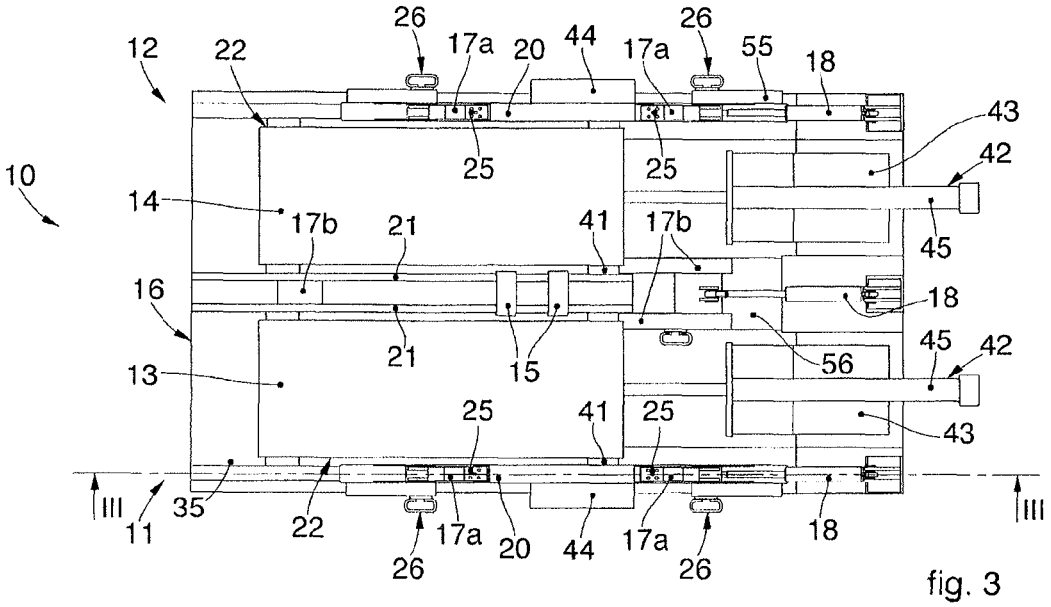
FIG. 3 is a plan view of FIG. 1.

According to the forms of embodiment shown in FIGS. 1-3, the machine for winding coils 10 comprises two support frames, respectively a first support frame 11 and a second support frame 12, on each of which a first belt 13 and respectively a second belt 14 are installed.

The first support frame 11 and the second support frame 12 are disposed adjacent to one another and both located in cooperation with the winding shaft A. In particular, the first belt 13 and the second belt 14 cooperate with a predefined axial portion of the winding shaft A during use.

Hereafter, in the description, unless expressly indicated, reference will be made generically to at least one support frame 11, 12, meaning that the characteristics expressed can refer without distinction to either the first support frame 11 or the second support frame 12.

According to a possible form of embodiment, the first belt 13 and the second belt 14 have a closed-ring shape.

The first belt 13 and the second belt 14 are installed respectively on the first support frame 11 and on the second support frame 12 so as to substantially surround them peripherally.

According to possible solutions, the first belt 13 and the second belt 14 can be made of metal, merely by way of example, of steel. However, it is not excluded that in other forms of embodiment the first belt 13 and/or the second belt 14 are made of polymer materials, natural or artificial fibers or possible combinations thereof.

According to possible solutions, the machine for winding coils 10 comprises a platform 16 on which the at least one support frame 11, 12 is positioned.

According to a possible solution, the platform 16 has a plan development substantially equal to the plan development of the at least one support frame 11, 12.

According to the forms of embodiment shown in FIGS. 1-3, the platform 16 is configured to support both the first support frame 11 and the second support frame 12.

According to a possible variant, not shown in the drawings, the first support frame 11 and the second support frame 12 can each be supported by its own platform. According to this form of embodiment, possibly, the two platforms can be reciprocally connected.

According to a possible form of embodiment, the platform 16 is defined by a frame 55 configured as a frame with a plan peripheral development at least equal to that of the at least one support frame 11, 12.

According to one solution, the frame 55 comprises a beam 56 located in a central position and configured to support a peripheral edge of both the first support frame 11 and the second support frame 12.

According to some implementations of the present invention, the platform 16 can be provided with support elements 17*a*, 17*b* configured to support the at least one support frame 11, 12, in a distanced position above the platform 16.

According to possible solutions, the support frame 11, 12 can be located in a position distanced from the platform 16 by a distance at least equal to, or more than, the thickness of the belt 13, 14. Merely by way of example, the support frame 11, 12 is distanced from the platform 16 by a distance comprised between 30 mm and 100 mm.

According to a possible solution, the support elements 17*a*, 17*b* are configured to support the at least one support frame 11, 12 on its periphery, that is, in correspondence with its peripheral edges.

According to some forms of embodiment, the belt 13, 14 installed on the at least one support frame 11, 12, is disposed in the space comprised between the support elements 17*a*, 17*b*.

According to possible forms of embodiment, the support elements 17*a*, 17*b* are installed on the frame 55 of the platform 16.

According to a possible form of embodiment shown in FIGS. 2-8, the platform 16 is provided with first support elements 17*a* configured to support the at least one support frame 11, 12, in correspondence with a first lateral flank 20, and with second support elements 17*b* configured to support the at least one support frame 11, 12 in correspondence with a second lateral flank 21, opposite the first lateral flank 20.

The first lateral flank 20 and the second lateral flank 21 can be disposed parallel to the direction of feed D.

If the machine for winding coils 10 comprises both the first support frame 11 and the second support frame 12, their first support elements 17*a* are installed on the periphery of the platform 16, in this specific case the frame 55, while the second support elements 17*b* are installed in a central position of the platform 16, in this specific case on the beam 56 attached centrally to the frame 55.

According to possible forms of embodiment, shown for example in FIGS. 1-8, two first support elements 17*a* can be provided, each configured to support the at least one support frame 11, 12, in correspondence with one of the ends of the first lateral flank 20, and two second support elements 17*b* can be provided, each configured to support the at least one support frame 11, 12, in correspondence with one of the ends of the second lateral flank 21.

According to possible forms of embodiment, shown for example with reference to FIGS. 1-3, the at least one support frame 11, 12 comprises a support body 22 interposed between the first lateral flank 20 and the second lateral flank 21 and on which the belt 13 and 14 is respectively installed during use.

According to possible forms of embodiment, actuation members 18 are associated with at least some of the support elements 17*a*, 17*b*, and are able to be selectively actuated to take the support elements 17*a*, 17*b* to a first operating position of constraint between the at least one support frame 11, 12, and the platform 16, and a second non-operating position of non-interference with the at least one support frame 11, 12. In particular, in the second non-operating position of the support elements 17*a*, 17*b*, between the platform 16 and the at least one support frame 11, 12 an interspace 19 is defined, suitable for the insertion and installation of the belt 13, 14 on the at least one support frame 11, 12.

According to a possible form of embodiment, the first support elements 17*a* are associated with the actuation members 18, and when the first support elements 17*a* are in their second non-operating position, at least the second support elements 17*b* support the respective support frame 11, 12, in correspondence with the second lateral flank 21, keeping the support body 22 and the first lateral flank 20 cantilevered.

According to a possible form of embodiment, the actuation members 18 are configured to move at least the first support elements 17*a* reciprocally nearer to/away from each other in a direction parallel to the direction of feed D, to dispose them in their operating or non-operating positions. In particular, in the passage from the second non-operating position to the first operating position, the first support elements 17*a* are moved nearer to the at least one support frame 11, 12, interposed between them so as to determine the fixed and solid positioning with the platform 16.

On the contrary, when the first support elements 17*a* are in their second non-operating position, between the first support elements 17*a* and the respective support frame 11, 12, a passage gap 30 is defined (FIGS. 5 and 8) through which it is possible to make the belt 13, 14 pass.

The passage gap 30, together with the interspace 19, renders the entire peripheral surface at least of the support body 22 and its first lateral flank 20 free and not connected to fixed parts or connecting/support parts with the platform 16. This facilitates both the lateral installation operations of the belt 13, 14, since it is not necessary to disconnect the meshes to allow it to be positioned on the support frame, and also the lateral removal operations thereof. It is therefore possible to carry out an installation or removal of the belt 13, 14 by means of lateral insertion/extraction, that is, in an orthogonal direction with respect to the direction of feed D of the rolled product P.

According to a possible implementation, at least one of the second support elements 17*b*, in this specific case the second support element 17*b* located in the front part of the platform 16, is installed in a fixed position with respect to the latter. This allows to define an abutment for the precise and predefined positioning of the at least one support frame 11, 12, with respect to the platform 16.

According to a possible solution, the second support elements 17*b* can be kept in a substantially fixed position to constrain the support frame 11, 12 to the platform 16, at least during normal use or ordinary maintenance of the machine for winding coils 10. By the term ordinary maintenance we include possible operations to replace the belt 13 or 14 from the support frame 11 or 12.

Figure 6:
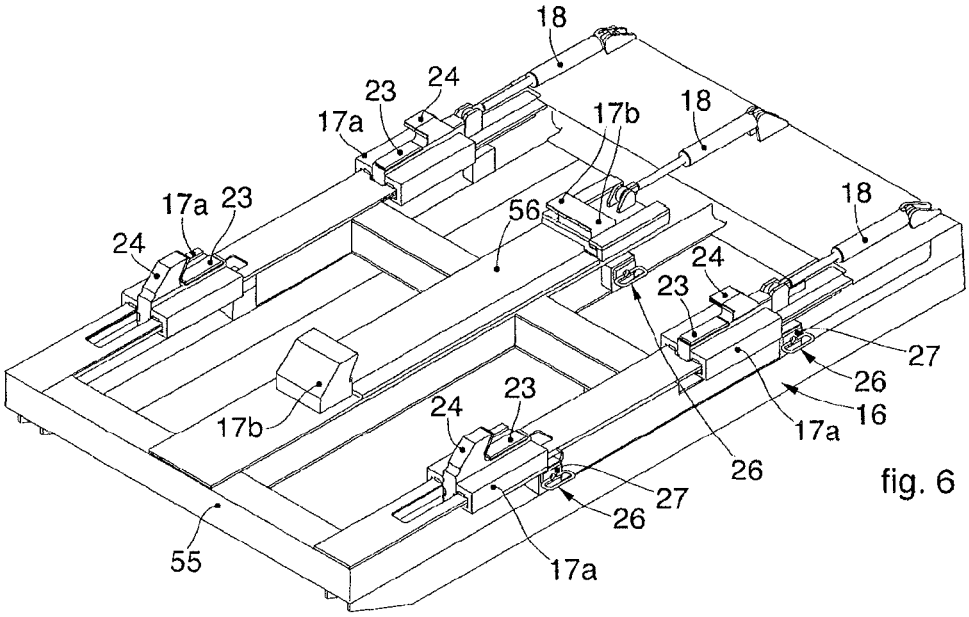
FIG. 6 is an enlarged perspective view of a component of the machine in FIG. 2.

According to a possible form of embodiment, shown for example in FIG. 6, at least the first support elements 17*a* each comprise a support clamp 23 in a single body installed sliding on guides provided on the platform 16, and a striker 24 able to be positioned, during use, against an abutment 25 provided on the support frame 11 and 12.

The guides can be disposed substantially parallel to the direction of feed D of the rolled product P.

Each support clamp 23 is provided with a resting surface on which, in the first operating position of the first support elements 17*a*, the support frame 11 and 12 rests.

The striker 24 and the abutment 25 have mating profiles so that, when the first support elements 17*a* are in their first operating position, the striker 24 and the abutment 25 reciprocally couple, constraining the position of the support frame 11, 12 to the platform 16.

According to the forms of embodiment shown in FIGS. 1-8, the striker 24 and the abutment 25 have a configuration with an inclined plane.

According to some solutions of the present invention, the second support elements 17*b* too can include a support clamp 23 and a striker 24 as described above with regard to the first support elements 17*a*.

According to some solutions, it can be provided that the support clamp 23 of the second support element 17*b* positioned in the front part of the platform 16 is solidly attached to the support frame 11, 12, for example by welding, or releasably, for example by means of threaded connections or releasable attachment means.

According to one solution, an actuation member 18 as described above is associated with at least one of the second support elements 17*b*, in this specific case the second support element 17*b* located in the rear part of the platform 16. The actuation member 18 is provided to take the second support element 17*b* into the first operating position or the second non-operating position This allows to selectively remove the support frame 11, 12 from the platform 16, for example for extraordinary maintenance interventions.

In particular, the actuation member 18 associated with the second support element 17*b* allows to thrust the support frame 11, 12 against the second support element 17*b* that is fixed, determining the constraint of the support frame 11, 12 to the platform 16 in a fixed position.

According to some solutions of the present invention, the first support frame 11 and the second support frame 12 are located adjacent to each other in a direction substantially orthogonal to the direction of feed D of the rolled product P.

According to a possible form of embodiment, the first support frame 11 and the second support frame 12 are connected solidly to each other.

According to possible forms of embodiment, the reciprocal connection of the first support frame 11 and the second support frame 12 occurs in proximity to their respective second lateral flanks 21.

According to the forms of embodiment shown in FIGS. 2 and 3, between the first support frame 11 and the second support frame 12 connection brackets 15 can be provided to connect them.

Respective first support elements 17*a* and second support elements 17*b* are associated with each of the first support frame 11 and second support frame 12, in the same way as described above.

In this way, when the replacement of one of the belts is required, for example the first belt 13, the activation of the actuation members 18 associated with the first support elements 17*a* alone, which support the first support frame 11, is commanded in order to take them into their second non-operating position.

The first support frame 11 is disposed temporarily cantilevered with its support body 22 and with its first lateral flank 20.

The first support frame 11 rests on the platform 16 by means of its respective second support elements 17*b*. Moreover, thanks to the fact that the first support frame 11 and the second support frame 12 are reciprocally connected, part of the load of the first support frame 11 is supported and/or counter-balanced by the second support frame 12 too, by means of its first support elements 17*a* and its second support elements 17*b*.

According to a possible form of embodiment, if the machine for winding coils 10 comprises the first support frame 11 and the second support frame 12, their respective second support elements 17*b* are associated with a central portion of the platform 16.

According to this form of embodiment, the second support elements 17*b* of the first support frame 11 can be configured to support the second support frame 12 as well.

This allows to reduce the number of support components and have second support elements 17*b* in common in order to support both the first support frame 11 and the second support frame 12.

Figure 7:
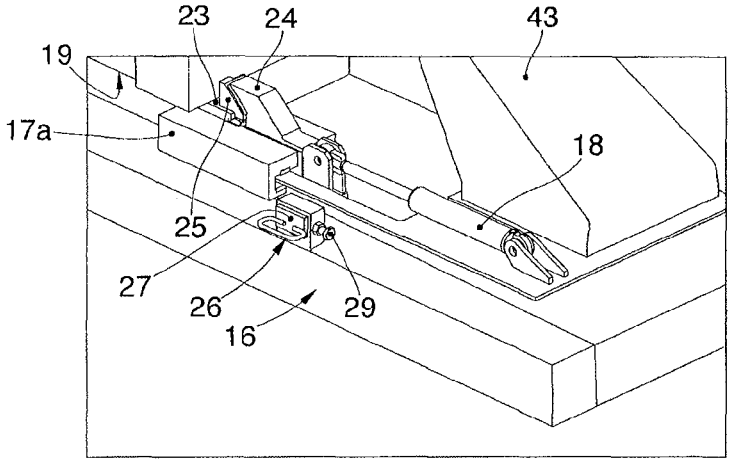
FIG. 7 is an enlarged perspective view of part of the machine of FIG. 2 in a first operating condition.

According to possible forms of embodiment, a respective safety device 26 is associated with at least some of the support elements 17*a*, 17*b*, in this specific case to each of the first support elements 17*a*, and is configured to keep the first support element 17*a* connected thereto in its first operating position, constraining the support frame 11, 12 to the platform 16 (FIG. 7).

This prevents, during normal use, the support frame 11, 12 from accidentally disconnecting from the platform 16, creating safety problems.

Figure 8:
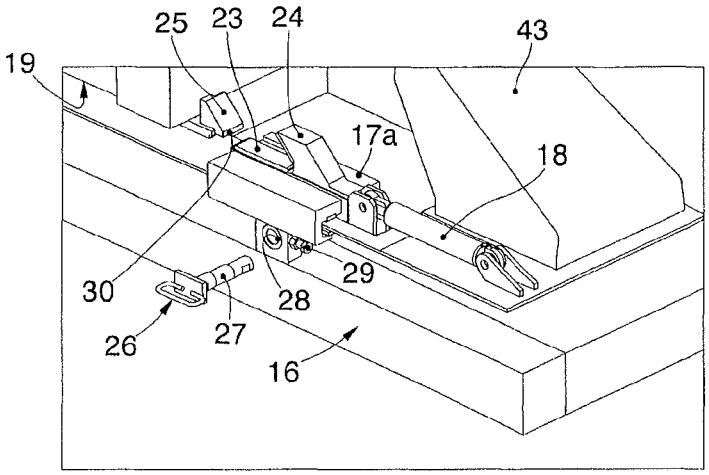
FIG. 8 is a perspective view of the part of the machine of FIG. 7 in a second operating condition.

According to the form of embodiment shown in FIGS. 6-8, the safety device 26 comprises a clamping pin 27 which can be inserted in holes 28 made in the platform 16 and in the support elements 17*a*, 17*b*. The hole 28 made in the first support elements 17*a* can be made, for example, in the support clamp 23.

The clamping pin 27 constrains the position of the support elements 17*a*, 17*b* with respect to the platform 16, as shown in FIG. 7, in their first operating position.

If the first support elements 17*a* have to be taken into their second non-operating position (FIG. 8), the clamping pin 27 is released from the holes 28, allowing to activate the actuation members 18.

An interference element 29, in this specific case a screw, can also be associated with the clamping pin 27, and is configured to constrain the axial position of the clamping pin 27 in the holes 28.

This prevents an accidental removal of the clamping pin 27 from the holes 28 with consequent safety problems.

According to a possible form of embodiment, the safety device 26 can also be associated with at least one of the second support elements 17*b* to constrain its positioning. In the case shown in the form of embodiment in FIG. 6, the safety device 26 is associated with the second support element 17*b* located in the rear part of the support frame 11, 12.

According to possible solutions, the safety device 26 can also be associated with a detector, for example an end-of-travel, configured to detect an active or inactive condition of the safety device 26. Merely by way of example, the detector can be configured to detect the condition of the clamping pin 27 inserted in the holes 28.

According to a possible form of embodiment, the at least one support frame 11, 12 comprises a concave portion 31 configured to at least partly house the winding shaft A during use.

According to one form of embodiment of the invention, the at least one support frame 11, 12 comprises a pair of first arms 32 installed on the support frame 11, 12 in correspondence with the concave portion 31.

Each first arm 32 of the pair is installed on one of the lateral flanks 20, 21 of the support frame 11, 12.

Each pair of first arms 32 is configured to support a first return roll 34 and a second return roll 35 on which the first belt 13 or the second belt 14 is partly wound.

The first arms 32 have an arched conformation so as to define a concavity 36 (FIG. 2) in which to house the winding shaft A during use.

According to some solutions of the present invention, each of the first arms 32 is associated with actuation members, not shown in the drawings and configured to make the first arms 32 rotate around an axis of rotation located inside the concavity 36 during use. This allows to rotate the first arms 32 so that their concavity 36 is disposed during use in a position suitable first to house and then to surround the winding shaft A.

According to one solution, shown in FIG. 2, the first return roll 34 and the second return roll 35 are each installed in proximity to one of the opposite ends of the first arm 32. During use the belt 13, 14 is wound at least around the first return roll 34.

The support body 22 of each support frame 11, 12 is provided with a plurality of support and/or return rolls 41 disposed substantially on the periphery of the support frame 11, 12 and on which the belt 13, 14 rests. Some of the support and/or return rolls 41 can be installed on the support frame 11, 12 also in correspondence with the concave portion 31, in order to control the positioning of the belt 13, 14 and keep it in a peripheral position on the support frame 11, 12.

When installed, the belt 13, 14 is located resting on the support and/or return rolls 41 and is wound around the first return roll 34 and the second return roll 35 in a closed-ring path.

Motors 44 are associated with at least one of the support and/or return rolls 41, in this specific case two of the support and/or return rolls 41, and are configured to make the support and/or return rolls 41 to which they are associated rotate. The motorized support and/or return rolls 41, in their turn, transfer the motion to the belt 13, 14 that is fed in a direction suitable to facilitate the winding action of the rolled product P on the winding shaft A.

According to a possible form of embodiment of the present invention, the machine for winding coils 10 can comprise at least a tensioner device 42, in this specific case two tensioner devices 42, each of which configured to regulate the tension imparted to the first belt 13 or respectively to the second belt 14 during use.

The tensioner device 42 can be installed on the platform 16 by means of a frame 43. The frame 43 can be installed on the platform 16 in the rear part of the support frame 11, 12, that is, in an opposite position to the concave portion 31.

The tensioner device 42 can comprise a linear actuator 45 attached, for example with its external jacket, to the frame 43.

Figure 5:
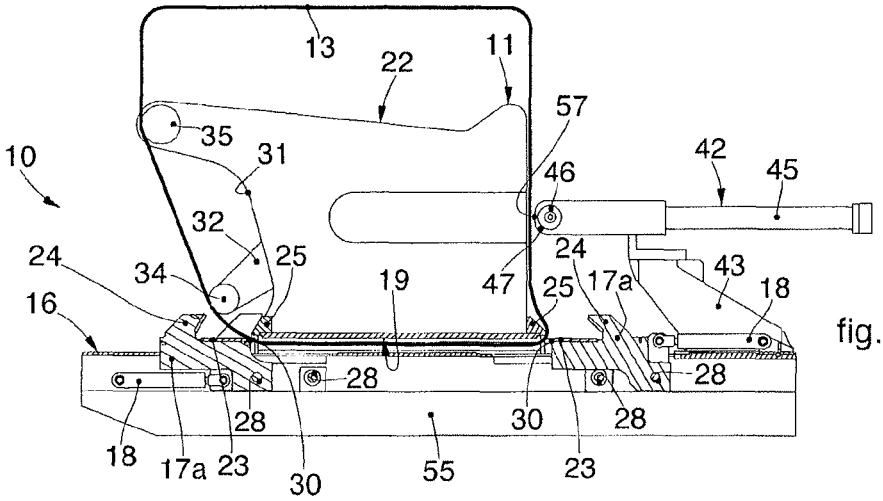
FIG. 5 is a view of FIG. 4 of the machine in a second operating position.

The linear actuator 45 is provided with a free thrust end 47 that contacts the belt 13, 14 during use. The linear actuator 45 is configured to take the free thrust end 47 to an active position inside the bulk of the at least one support frame 11, 12 and to a second inactive position completely outside the support frame 11, 12, in order to define with the latter a free space 57 for the insertion or removal of the belt 13, 14 (FIG. 5).

The free thrust end 47 can be provided with a tensioner cylinder 46 that contacts the belt 13, 14 and reduces the friction on the latter.

The tensioner cylinder 46 is selectively taken, by the action of the linear actuator 45, into a position inside the support body 22, and generates a tensing loop to regulate the tension in the belt 13, 14.

The activation of the tensioner cylinder 46 can be selectively controlled continuously during the use of the machine for winding coils 10 and the movement of its components in order to guarantee a constant tensioning of the belt 13, 14.

According to one form of embodiment of the present invention, the platform 16 is installed on a structure 51, fixed with respect to a support plane.

The structure 51 can be provided with sliding guides 52 on which the platform 16 is slidingly installed.

A translation member 53 is connected to the structure 51 and to the platform 16 and is configured to allow the controlled translation of the platform 16 along the sliding guides 52 so as to take the at least one support frame 11, 12 to a non-operating position, where it is retracted with respect to the winding shaft A, and an operating condition (FIG. 1) where the support frame 11, 12 is positioned so that its concave portion 31 houses the winding shaft A.

According to a possible solution, the sliding guides 52 are installed inclined on the structure 51, in order to support and translate the platform 16 downward in its passage from its non-operating to its operating condition.

According to a possible solution, the machine for winding coils 10 comprises a management and control unit configured to manage the activation of the components of the machine for winding coils 10 both during its normal use and also, when required, for the operations to replace the belt 13, 14.

In the latter case, the management and control unit is configured to implement a specific program to change the belt 13, 14.

The sequence of steps managed by the program to replace the belt 13, 14 is such as to guarantee that the operations are carried out safely and that all of the components not involved in the replacement of the belt cannot move in any way.

According to some solutions, the management and control unit is configured at least to control the selective activation of the actuation members 18. For example it can provide that the activation of the actuation members 18 is carried out only if at least one of the following conditions occurs: the platform 16 is located in its non-operating condition, the translation member 53 is blocked in its movements, the safety devices 26 are de-activated, the tensioner device 42 is in the non-operating condition, the first arms 32 are in the closed condition of the concave portion 31.

We shall now describe the functioning of the machine for winding coils 10.

When the procedure of winding a rolled product P is started, the support frame 11, 12 is translated along the sliding guides 52 and taken from its non-operating condition to the operating condition in which it is disposed near the winding shaft A.

During this translation, the first arms 32 are positioned in a condition of non-interference with the position of the winding shaft A. In particular, the first arms 32 are positioned so as to keep the maximum aperture allowed of the concave portion 31.

When the support frame 11, 12 is positioned in the operating condition, the portion of belt 13, 14 that is found, on each occasion, in correspondence with the concave portion 31, at least partly surrounds the external surface of the winding shaft A, as shown in FIG. 4.

Subsequently, the first arms 32 are activated to move into a partially closed condition of the concave portion 31.

During this activation, the portion of belt 13, 14 comprised in proximity to the concave portion 31 is wound around the external surface of the winding shaft A for a substantial part of the latter.

According to a possible solution, the belt 13, 14 is wound around the winding shaft A for an angle comprised between 200° and 320°, preferably for at least 270°.

The rolled product P is conveyed in the interspace comprised between the belt 13, 14 and the winding shaft A.

In this condition, at least the winding shaft A is made to rotate, to determine the winding of the rolled product P around the external surface of the winding shaft A.

According to a possible solution, the belt 13, 14 is also driven with a substantially synchronous movement with the rotation movement of the winding shaft A.

During winding, the rolled product P, due to the action of the belt 13, 14, is pressed or calendered against the external surface of the winding shaft A.

After some spirals of rolled product P have been wound, the latter is made solid with the winding shaft A and the winding process of the rolled product P can continue without the help of the machine for winding coils 10. Possible forms of embodiment can provide that the winding shaft A is the expanding type and that, once some spirals have been wound, the winding shaft A expands to make the position of the rolled product P solid on the winding shaft A.

Subsequently it is provided to take the support frame 11, 12 into the non-operating condition.

In particular, the first arms 32 are taken into a position of non-interference with the winding shaft A and the support frame 11, 12 is translated along the sliding guide 52 away from the winding shaft A.

When it is required to replace the belt 13, 14, the support frame 11, 12 is taken into its non-operating and retracted condition of non-interference with the winding shaft A.

In particular, if the machine for winding coils 10 is provided with a first support frame 11 and a second support frame 12, the operation to replace the respective first 13 and second 14 belt is carried out first on one support frame and then on the other.

Hereafter we shall describe the method to replace the belt 13, 14 only of one support frame 11, 12, as the same operations are applicable for the other support frame 11, 12.

The operations to replace the belt 13, 14 provide that the safety device 26 is de-activated to allow the activation of the actuation members 18.

In particular, the clamping pin 27 is removed from the holes 28, releasing the stable attachment of the support clamps 23 to the platform 16.

In this condition, the actuation members 18 associated with the first support elements 17*a* are activated to take the latter into their second non-operating position.

The passage gap 30 described above is thus defined between the first support elements 17*a* and the support frame 11, and the interspace 19 is defined between the platform 16 and the support frame 11, 12.

In this position, the first support frame 11 is cantilevered with its support body 22 and with its first lateral flank 20.

The belt 13, 14, which is substantially positioned to surround the support frame 11, 12 peripherally, can be extracted laterally from the first lateral flank 20 without requiring a division of the belt 13, 14 for its removal.

Similarly, a lateral insertion action of the new belt 13 can be provided through the first lateral flank 20.

The belt 13 is located resting on the support and/or return rolls 41 and is at least partly wound around the first return roll 34 and the second return roll 35.

Once the belt 13 is positioned on the support frame 11, 12, the activation of the actuation members 18 is commanded to take the first support elements 17*a* into their first operating position and to completely constrain the support frame 11, 12 to the platform 16.

This operation of at least controlled activation of the first support elements 17*a* can be managed and controlled automatically by the management and control unit.

During these operations the installation of structures to facilitate maintenance can be provided, such as platforms or walkways, for the safe movement of the operators.

It is clear that modifications and/or additions of parts may be made to the machine for winding coils 10 as described heretofore, without departing from the field and scope of the present invention.

It is also clear that, although the present invention has been described with reference to some specific examples, a person of skill in the art shall certainly be able to achieve many other equivalent forms of machine for winding coils 10, having the characteristics as set forth in the claims and hence all coming within the field of protection defined thereby.

The invention claimed is:

1. A machine for winding coils comprising at least one support frame, a belt having a closed-ring configuration installed on the support frame so as to substantially surround the at least one support frame peripherally, and a platform on which the at least one support frame is positioned, wherein said platform is provided with support elements configured to selectively support the at least one support frame in a distanced position with respect to the platform, and actuation members are associated with at least some of said support elements able to be selectively activated to take at least some of said support elements to a first operating position constraining the support frame to the platform, and to a second non-operating position of non-interference with said support frame to define an interspace between said platform and said support frame suitable for the lateral insertion or lateral removal of said belt on said support frame.

2. The machine as in claim 1, wherein said platform is provided with first support elements configured to support the at least one support frame in correspondence with a first lateral flank thereof, and with second support elements configured to support the at least one support frame in correspondence with a second lateral flank thereof, opposite the first lateral flank, and in that said actuation members are associated at least with one of either said first support elements or said second support elements.

3. The machine as in claim 2, wherein said at least one support frame comprises a support body interposed between the first lateral flank and the second lateral flank and on which said belt is installed during use.

4. The machine as in claim 2, wherein said actuation members are associated with said first support elements, and when said first support elements are in their second non-operating position, at least said second support elements support said support frame in correspondence with said second lateral flank, keeping said support body and said first lateral flank cantilevered.

5. The machine as in claim 4, wherein at least one of said second support elements is installed in a fixed position on said platform.

6. The machine as in claim 1, further comprising a first support frame and a second support frame disposed adjacent to each other, connected to each other solidly and installed on said platform.

7. The machine as in claim 6, wherein the first support elements of the first support frame and of the second support frame are installed on the periphery of the platform, and the second support elements of the first support frame and of the second support frame are installed in a central position of the platform.

8. The machine as in claim 1, further comprising a tensioner device configured to regulate the tension imparted to said belt.

9. The machines as in claim 8, wherein the tensioner device comprises a linear actuator provided with a free thrust end which contacts said belt during use, said linear actuator being configured to take the free thrust end to an active position inside the at least one support frame, and a second position, not active and completely outside the support frame, to define with the latter a free space for the insertion or removal of the belt.

10. The machine as in claim 1, further comprising a structure provided with sliding guides on which said platform is slidingly installed.

* * * * *